US011371460B1

(12) United States Patent
Revidat et al.

(10) Patent No.: US 11,371,460 B1
(45) Date of Patent: Jun. 28, 2022

(54) FUEL INJECTION SYSTEM FOR AN INTERNAL COMBUSTION ENGINE AND METHOD AND CONTROL DEVICE FOR CONTROLLING A FUEL INJECTION SYSTEM OF AN INTERNAL COMBUSTION ENGINE

(71) Applicants: Hyundai Motor Company, Seoul (KR); Kia Corporation, Seoul (KR)

(72) Inventors: Stephan Revidat, Langen (DE); David Martinez Nunez, Frankfurt am Main (DE)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/340,848

(22) Filed: Jun. 7, 2021

(30) Foreign Application Priority Data

Mar. 2, 2021 (DE) ..... 102021202000.3

(51) Int. Cl.
*F02M 1/00* (2006.01)
*F02D 41/38* (2006.01)
*F02M 59/20* (2006.01)
*F02M 55/02* (2006.01)

(52) U.S. Cl.
CPC ..... *F02D 41/3845* (2013.01); *F02M 55/025* (2013.01); *F02M 59/20* (2013.01); *F02D 2200/0602* (2013.01)

(58) Field of Classification Search
CPC ..... F02D 2200/0602; F02D 41/3845; F02D 41/3809; F02D 41/3836; F02D 41/3863; F02D 2250/31; F02M 63/0265; F02M 55/025; F02M 69/465
USPC ..... 123/445, 446, 447, 456, 457
See application file for complete search history.

(56) References Cited

U.S. PATENT DOCUMENTS 6,105,554 A * 8/2000 Nishiyama ..... F02D 41/12 123/436
6,293,757 B1 * 9/2001 Oda ..... F02M 63/0225 417/53
6,446,610 B1 * 9/2002 Mazet ..... F02D 41/3818 123/357
2008/0025849 A1 * 1/2008 Okamoto ..... F02D 41/3845 417/213
2014/0251275 A1 * 9/2014 Lana ..... F02D 41/0085 123/452
2015/0198081 A1 * 7/2015 Surnilla ..... F02D 41/3854 123/294

(Continued)

*Primary Examiner* — John Kwon
(74) *Attorney, Agent, or Firm* — Fox Rothschild LLP

(57) ABSTRACT

A control method of a fuel injection system is provided. The method includes receiving a set value for a target pressure in an injection rail that provides fuel to the engine and receiving an output demand representing a target amount of fuel to be injected from the injection rail per engine cycle. A control mode signal is received and an actual pressure in the injection rail is measured. A control mode is selected based on the control mode signal. A fuel pump flow demand for a fuel pump connected to the injection rail is determined based on a difference between the set value for the target pressure and the actual pressure, based on the output demand, and based on the selected control mode. The fuel pump is then operated according to the fuel pump flow demand and based on the selected control mode to provide fuel to the injection rail.

7 Claims, 6 Drawing Sheets

(56) References Cited

U.S. PATENT DOCUMENTS

2018/0320627 A1* 11/2018 Hoshi ..... F02D 19/0636
2019/0063356 A1* 2/2019 Hoshi ..... F02D 35/02

* cited by examiner

FUEL INJECTION SYSTEM FOR AN INTERNAL COMBUSTION ENGINE AND METHOD AND CONTROL DEVICE FOR CONTROLLING A FUEL INJECTION SYSTEM OF AN INTERNAL COMBUSTION ENGINE

CROSS-REFERENCE TO RELATED APPLICATION

This application claims the benefit of priority to German Patent Application No. 102021202000.3, filed on Mar. 2, 2021, the disclosure of which is hereby incorporated in its entirety by reference.

TECHNICAL FIELD

The present invention relates to a fuel injection system for an internal combustion engine, to a method and a control device for controlling a fuel injection system of an internal combustion engine.

BACKGROUND

Internal combustion engines typically comprise a fuel supply or injection system including an injection rail and a high pressure fuel pump supplying pressurized fuel to the injection rail. From the injection rail, the pressurized fuel is injected into a combustion chamber of the engine where it is burned to move a piston to generate torque. Typically, the high pressure fuel pump is operated synchronously with a rotational speed of the engine which allows to maintain a calibrated target pressure in the injection rail.

Although this operational scheme is robust and reliable, there are situations in which it would be desirable to be able to more flexibility operate the fuel supply system. For example, different fuel supply characteristics are desirable in situations in which dynamic load variations are applied to the engine than in situations in which a more or less constant load is applied to the motor.

SUMMARY

It is one of the ideas of the present invention to provide improved solutions for a fuel supply of an internal combustion engine.

According to a first aspect of the invention, a method for controlling a fuel injection system of an internal combustion engine may include receiving a set value for a target pressure in an injection rail that provides fuel to the engine, receiving an output demand representing a target amount of fuel to be injected from the injection rail per engine cycle, receiving a control mode signal, capturing an actual pressure in the injection rail, selecting a control mode based on the control mode signal, determining a fuel pump flow demand for a fuel pump connected to the injection rail based on a difference between the set value for the target pressure and the actual pressure, based on the output demand, and based on the selected control mode, and operating the fuel pump according to the fuel pump flow demand and based on the selected control mode to provide fuel to the injection rail. The fuel pump is operated independently from a rotational speed of the engine.

According to a second aspect of the invention, a control device for controlling a fuel injection system of an engine may include an input interface configured to receive a set value for a target pressure in an injection rail that provides fuel to the engine, an output demand representing a target amount of fuel to be injected from the injection rail per engine cycle, a control mode signal, and a captured actual pressure in the injection rail, an output interface configured for signal connection to a fuel pump that is hydraulically connected to the injection rail, and a processing unit connected to the input interface and the output interface. The processing unit is configured to operate a fuel injection system according to a method according to the first aspect of the invention.

In particular, the processing unit is configured to select a control mode based on the control mode signal, to determine a fuel pump flow demand for the fuel pump based on a difference between the set value for the target pressure and the actual pressure, based on the output demand, and based on the selected control mode, and to issue a control signal to the output interface for operating the fuel pump according to the fuel pump flow demand and based on the selected control mode to provide fuel to the injection rail. The fuel pump is operated independently from a rotational speed of the engine. The processing unit may include a processor, an ASIC, an FPGA, or similar. The processing unit is configured to read a data storage medium, e.g. a non-volatile storage medium such as a HDD storage or an SSD storage, and execute software stored in the data storage medium. The data storage medium may be a part of the control device or the control device may have access to the data storage medium via the input interface.

According to a third aspect of the invention, a fuel injection system for an internal combustion engine is provided. The fuel injection system includes a control device according to the second aspect of the invention, an injection rail to provide fuel to the engine, a pressure sensor signal connected to the input interface of the control device and configured to capture an actual pressure in the injection rail, and a fuel pump hydraulically connected to the injection rail and signal connected to the output interface of the control device. The fuel pump is operable or drivable independently from a rotational speed of the engine.

One of the ideas on which the present invention is based is to operate the fuel pump, which delivers high pressure fuel to the injection rail, independently from the rotational speed of the engine and operate the fuel pump according to a desired control mode. The control mode is selected based on a control mode signal which may be issued by an engine control unit (ECU), e.g. depending on an operational state of the engine and/or based on an input via a user interface. Generally, the fuel pump is operated such that a specific amount of fuel is provided to the injection rail to be able to inject the amount of fuel into the combustion chamber of the engine to meet the desired torque output that corresponds to an output demand.

The operation of the fuel pump is further governed by a target pressure that is to be present in the injection rail. The target pressure may depend on the selected control mode. Further, the amount of fuel which is actually delivered to the injection rail by the pump is dependent on the selected control mode. The control mode is considered in calculating or determining a fuel pump flow demand which is issued as a signal to the fuel pump. For example, an amount of fuel may already be present in the injection rail which is sufficient to generate the desired torque output of the engine so that only a reduced amount of fuel is to be transported into the rail, e.g. to adjust the actual pressure to meet the target pressure.

One advantage of the present invention is that, since a control mode is selected, and since the fuel pump is able to work independently from the rotational speed of the engine, the fuel injection system is more flexible. For example, depending on the selected control mode, the fuel pump may be operated to work at higher efficiencies, to improve dynamical behavior of the motor, to reduce particle emission of the engine, or similar.

According to some exemplary embodiments, the control mode is selected among a plurality of pre-stored control modes, wherein each control mode includes at least one of a set value of the target pressure and a target filling of the injection rail. The filling of the injection rail corresponds to the mass of fuel present or stored in the injection rail. The filling may be represented by various characteristic quantities, e.g. by a filling ratio which is a ratio of a corrected volume of fuel stored in the injection rail to a geometric volume of the injection rail. The corrected volume may correspond to the volume the fuel stored in the injection rail at the actual pressure in the rail would take would take at a reference pressure, e.g. the ambient pressure.

According to some exemplary embodiments, the set value of the target pressure, depending on the control mode, is a constant value or a dynamically varying value. The target pressure is preferably set by an engine control unit, e.g. in accordance with an engine control map. Accordingly, an injection or fuel supply characteristic may be varied more easily. In particular, the fuel may be supplied to the combustion chamber of the engine at a desired pressure. As the pump is driven independently from the rotational speed of the engine, the pressure in the rail may be adjusted more flexible to improve performance of the engine. For example, during cold start or when a dynamic behavior of the engine is desired, the rail pressure may be increased or generally varied in accordance with the selected control mode very flexible.

According to some exemplary embodiments, the method may further include calculating an actual filling of the injection rail based on the actual pressure and on a type of the fuel, and calculating a total filling of the injection rail based on the output demand. The operation of fuel pump may be adjusted such that the actual filling does not exceed an upper filling threshold and/or does not fall below a lower filling threshold. For example, the actual filling may be calculated as the filling ratio which is defined herein as $V_{cor}/V_0$, wherein $V_{cor}$ is a corrected volume of the fuel in the injection rail and $V_0$ is the geometric volume of the injection rail. The corrected volume may be determined according to the following equation:

$$V_{cor} = V_0 + R_F \frac{V_0 * \Delta p}{E} + R_A \frac{Vo}{\kappa \ln \frac{p_r}{p_0}}$$

In this equation, $p_0$ is a reference pressure, e.g. the ambient pressure, $R_F$ is volumetric percentage of pure fuel at a reference pressure $p_0$, $R_A$ is volumetric percentage of pure fuel at a reference pressure $p_0$, $p_r$ is the actual pressure in the injection rail, $\Delta p$ is the difference between rail pressure $p_r$ and reference pressure $p_0$, $\kappa$ is the heat capacity ratio of air, which might be set as 1.34, for example, E is the coefficient of elasticity of the pure fuel. A target filling of the injection rail may be determined as difference between the actual filling and the amount of fuel corresponding to the output demand under consideration of the set value for the target pressure. The upper filling threshold for the filling may be defined by a maximum allowable pressure of the injection rail. The lower filling threshold may be defined by a minimum amount of fuel to be present in the injection rail to maintain the target pressure and to inject the amount of fuel in accordance with the output demand.

According to some exemplary embodiments, in a first control mode, operating the fuel pump includes calculating a pump efficiency as a ratio of hydraulic power to be applied to the fuel and driving power to be applied to the pump to reach the target pressure in the injection rail. The pump is only operated when the calculated pump efficiency is above an efficiency threshold. The pump efficiency $\eta$ may be approximated for an electrically driven pump, for example, according to the following equation:

$$\eta = \frac{\left[\frac{\dot{m}_F + \dot{m}_L + \dot{m}_R}{\rho_F} * (p_r - p_t)\right]}{U_B * I_P}$$

In this equation $U_B$ is the electrical voltage and $I_P$ the electrical current applied to the pump. Further, $p_r$ is the target rail pressure, $p_t$ is pressure in the fluid source, e.g. a tank, to which the fuel pump is connected, and $\rho_F$ is the density of the fuel. $\dot{m}_F$ is the mass flow of fuel represented by the output demand, $\dot{m}_L$ is a mass flow of leaked fuel, and $\dot{m}_R$ is the mass flow of fuel required to maintain or reach the target pressure in the injection rail. The efficiency threshold, for example, may lie in the range between 0.25 and 0.5. For example, the efficiency threshold may be 0.4.

In the first control mode, the pump is only operated when this is possible at a high efficiency. Thus, the injection rail functions as a fuel storage which allows interrupting reducing operation of the fuel pump at low efficiency working points. Accordingly, the average efficiency of the fuel supply system may be remarkably increased.

According to some exemplary embodiments, when the calculated pump efficiency is less than the efficiency threshold the pump, the pump is only operated when the actual filling of the injection rail is less or equal than a filling threshold value depending on the fuel demand. The filling threshold value of this exemplary embodiment may form a lower filling threshold as mentioned above. In other words, according to this exemplary embodiment, the injection rail is charged even when the pump works at a low efficiency level to avoid draining of the injection rail.

According to some exemplary embodiments, in a second control mode, calculating the fuel pump flow demand may include determining a first fuel pump flow demand percentage based on the difference between the set value for the target pressure and the actual pressure and adding the determined first fuel pump flow demand percentage to a second fuel pump flow demand percentage proportional to, e.g. corresponding to, the output demand. An actual filling of the injection rail is calculated based on the actual pressure and on a type of the fuel. The operation of the fuel pump may include operating the fuel pump such that operation of the fuel pump is inhibited, in particular stopped, when the output demand compared to the actual filling exceeds a predetermined threshold. According to this exemplary embodiment, there is provided more than enough fuel to maintain or reach the target pressure in the injection rail and to supply the fuel amount corresponding to the output demand. In other words, actual pressure in the injection rail is adjusted to a level above the set value of the target pressure with the limitation that the actual pressure, which is proportional the actual filling, is maintained below an upper threshold level. Accordingly, a highly dynamic behavior of the engine may be achieved.

According to some exemplary embodiments, in a third control mode, calculating the fuel pump flow demand may include calculating an actual filling of the injection rail based on the actual pressure and on a type of the fuel, calculating an effective available filling of the injection rail as a difference between the actual filling and a maximum filling of the injection rail at the target pressure, and determining an effective demand by adding the output demand and the effective available filling volume. Thereby, the rail is maintained at substantially constant high pressure level since it is filled always to the desired target amount, e.g. close to a maximum possible filling.

Accordingly, particle emission of the engine may be advantageously reduced. Optionally, similar to the first control mode, operating the fuel pump in the third control mode may also include calculating a pump efficiency as a ratio of hydraulic power to be applied to the fuel and driving power to be applied to the pump to reach the target pressure in the injection rail. The pump is only operated when the calculated pump efficiency is greater than an efficiency threshold. However, the pump may optionally be actuated in a state that indicates fuel or pressure shortage in the injection rail.

The above-described features for the control device are also disclosed for the method and for the fuel injection system and vice versa.

BRIEF DESCRIPTION OF THE FIGURES

For a more complete understanding of the present invention and advantages thereof, reference is now made to the following description taken in conjunction with the accompanying drawings. The invention is explained in more detail below using exemplary embodiments, which are specified in the schematic figures, in which.

Unless indicated otherwise, in the figures like reference signs indicate like elements.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor and is specifically programmed to execute the processes described herein. The memory is configured to store the modules and the processor is specifically configured to execute said modules to perform one or more processes which are described further below.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Figure 1:
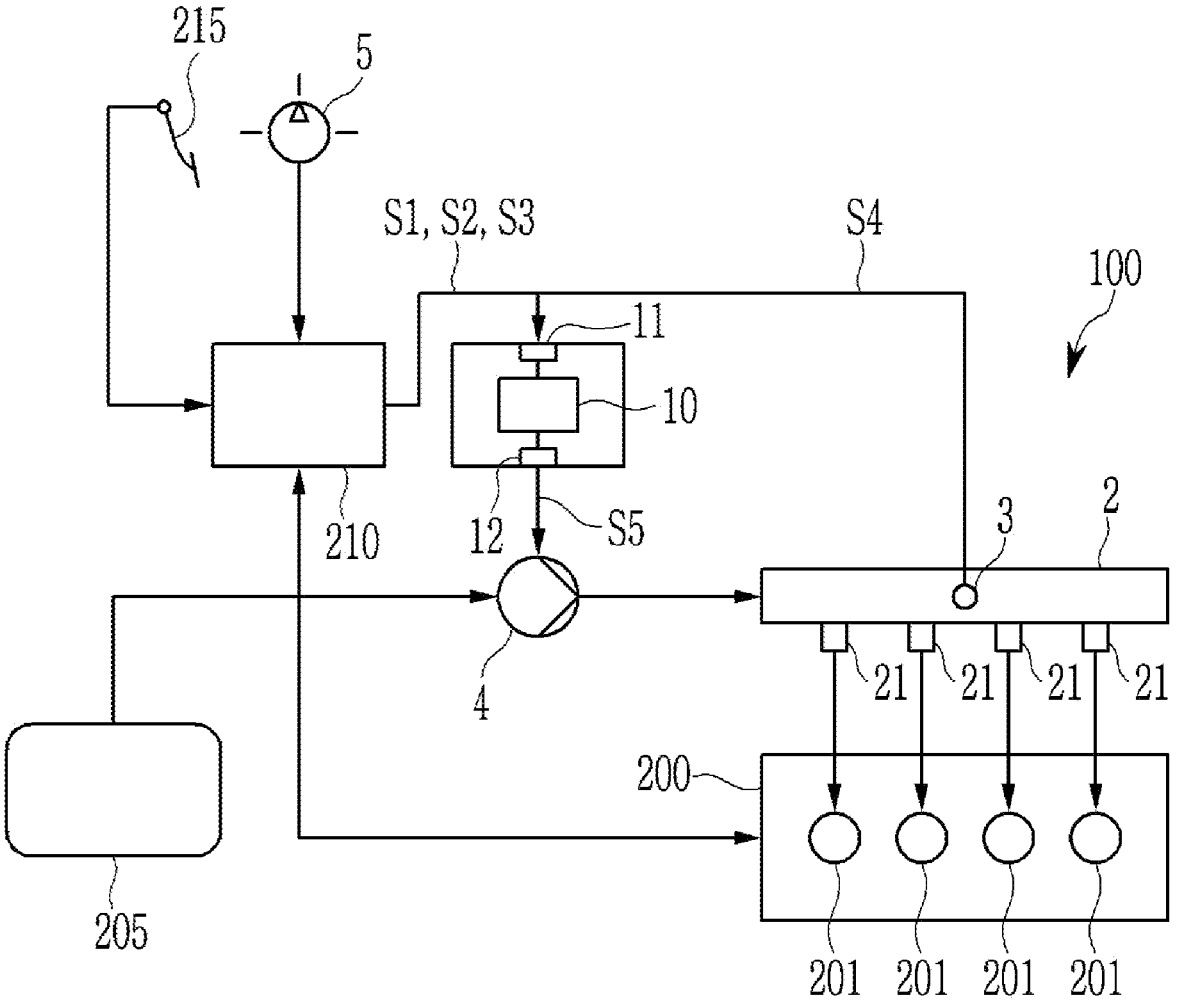
FIG. 1 shows a schematic view of fuel injection system according to an exemplary embodiment of the invention.

FIG. 1 shows a fuel injection system 100 for an internal combustion engine 200. The system 100 may, for example, be used in a vehicle, in particular in a street vehicle such as an automobile, a bus, a lorry, a motorcycle or similar.

As exemplarily shown in FIG. 1, the fuel injection system 100 may include a control device 1 (e.g., a controller), an injection rail 2, a pressure sensor 3, and a fuel pump 4. In FIG. 1, the system 100 is exemplarily shown as a part of a vehicle drive system including an internal combustion engine 200, a tank 205, an engine control unit (ECU), 210, and a gas pedal 215. As is further shown in FIG. 1, the fuel injection system 100 may optionally include a control mode selection switch 5. The tank 205 may also form part of the fuel supply system 100.

The injection rail 2 is only schematically shown in FIG. 1 and defines an internal space for receiving pressurized fuel. The internal space has a geometric volume. As is further schematically shown in FIG. 1, the injection rail 2 may be connected to the engine 200 such that pressurized fuel may be supplied from the internal space of the injection rail 2 into a combustion chamber 201 of the engine 200. For example, the injection rail 2 may include injectors 21 which are configured to inject fuel from the injection rail 2 into the respective combustion chamber 201 in accordance with a phase of the engine cycle, e.g. in accordance with a specific crank shaft angle.

The fuel pump 4 is hydraulically connected to the injection rail 2 and is configured to pressurize and transport fuel into the injection rail 2. In the example shown in FIG. 1, the fuel pump 4 is hydraulically connected to the tank 205 which, thus, forms a fuel source. The fuel pump 4 is configured to be operated independently from a rotational speed of the engine 200. For example, the fuel pump 4 may be driven by an electrical drive motor (not shown). Generally, the fuel pump 4 may be operated independently from a phase of the engine cycle. Operating the fuel pump may include varying of a rotational speed of the fuel pump to vary a fuel flow transported by the pump, to activating and deactivating the fuel pump, and/or varying a pressure increase applied to the fuel by the pump. The pressure sensor 3, as schematically shown in FIG. 1, is arranged at the injection rail 2 such that it is able to capture a pressure of the fuel in the internal space of the injection rail.

The control device 1 is only schematically shown in FIG. 1 as a block and may include a processing unit 10, an input interface 11, and an output interface 12. The processing unit 10 is signal connected to the input interface 11 and to the output interface and includes circuitry configured to issue an output signal based on an input signal in accordance with a predefined computing rule. For example, the processing unit 10 may include a CPU, a microprocessor, an ASIC, an FPGA, or similar. Optionally, control unit 10 may also include a data storage medium readable by the processing unit 10. Alternatively, the processing unit 10 may be connected to a data storage medium via the input interface 11. The data storage medium is a non-volatile data storage medium, e.g. a hard disk drive, a solid state drive, or similar.

The input interface 11 may be configured to receive and, optionally, to transmit signals. The output interface 12 may be configured to transmit and, optionally, receive signals. For example, the input and output interfaces 11, 12 may be configured for a wired connection, e.g. via a BUS system such as CAN-BUS or similar.

As is schematically shown in FIG. 1, the pressure sensor 3 may be configured to output a signal to the input interface 11 of the control device 1. Further, as shown in FIG. 1, the ECU 210 may be signal connected to the input interface 11 of the control device 1, wherein the gas pedal 215 and the mode selection switch 5, or another optional user interface, are signal connected to the ECU 210. Alternatively, the mode selection switch 5 and the gas pedal 215 may also be connected directly to the input interface 11 of the control device 1. As a further alternative, the control device 1 may form part of the ECU 210. In particular, an input interface (not shown) of the ECU 210 forms the input interface 11 of the control device 1 and an output interface (not shown) of the ECU 210 forms the output interface 11 of the control device 1. Therefore, the input interface 11, generally, may be configured to receive signals from the ECU 210 or other external sources and from the pressure sensor 3. The output interface 12 may be connected to the fuel pump 4. Generally, the processing unit 10 may be configured to generate a control signal based on an input signal received on the input interface 11 and issue the control signal to the output interface 12 to operate the fuel pump 4.

The ECU 210, as schematically shown in FIG. 1, is connected to the engine 200 and is configured to receive state signals representing an operational state of the engine 200, wherein the state signals, for example, are captured by sensors integrated in the engine 200. Further, the ECU 210 is configured to issue signals to the control device 1 and to the engine 200. The ECU 210 may include a processing device, such as a CPU, a microprocessor, an ASIC, an FPGA, or similar, and a non-volatile data storage medium, e.g. a hard disk drive, a solid state drive, or similar.

Figure 2:
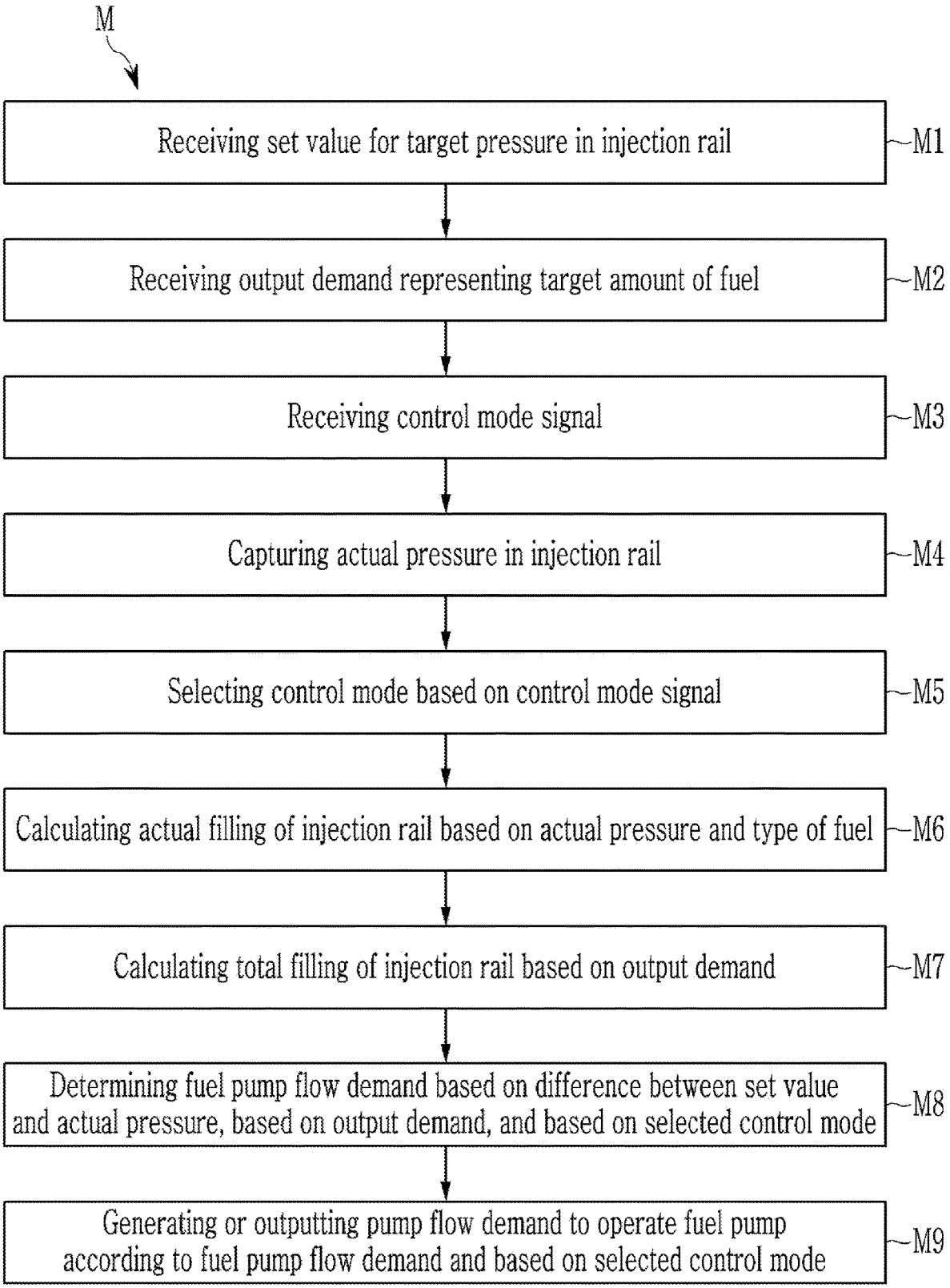
FIG. 2 shows a flow diagram of a method for controlling a fuel injection system according to an exemplary embodiment of the invention.

FIG. 2 exemplarily shows a flow scheme of a method for controlling a fuel injection system 100 of an internal combustion engine 200. For example, the control device 1 may control the fuel injection system 100 of FIG. 1 according the method M explained below by reference to FIG. 2. Therefore, by way of example, the method M will be explained by referring to the system 100 shown in FIG. 1.

In a first step M1, the control device 1 may be configured to receive a set value S1 for a target pressure in the injection rail 2 via the input interface 11, e.g. from the ECU 210. For example, the ECU 210 may be configured to output the set value S1 based on an actuation of the gas pedal 210 and/or based on the operational state of the engine 200. In particular, the ECU 210 may be configured to determine the set value S1 from a look-up-table or an engine map in which, for example, a torque demand and a rotational speed of the engine may be mapped with a target pressure in the injection rail 2. Actuation of the gas pedal 215 may be captured, for example, by a sensor (not shown) capturing a displacement of the gas pedal 215.

In step M2, the control device 1 may be configured to receive an output demand S2 representing a target amount of fuel to be injected from the injection rail 2 per engine cycle via the input interface 11. The output demand S2 may, for example, be a demand signal issued by the ECU 210 based on the actuation of the gas pedal 215.

In step M3, the control device 1 may be configured to receive a control mode signal S3 via the input interface 11. The control mode signal S3 may, optionally, also be issued by the ECU 210 based on a position of the mode selection switch 5. For example, a driver may select from a plurality of control modes such as "sport", "city drive", "eco/emission mode", or similar, by turning or otherwise adjusting the switch 5. Alternatively, it may also be possible that the ECU 210 generates the control mode signal based on the operational state of the engine.

Step M4 represents capturing an actual pressure S4 in the injection rail 2 by the pressure sensor 3, wherein the control device 1 may be configured to receive the captured actual pressure S4 via the input interface 11. In step M5, the control device 1 may be configured to select M5 a control mode based on the control mode signal S3, in particular from a plurality of pre-stored control modes. Depending on a control mode, different control schemes are applied. This concerns in particular the steps M8 and M9. In step M9, the control device 1 may be configured to determine a fuel pump flow demand S5 for the fuel pump 4 based on a difference between the set value S1 for the target pressure and the actual pressure S4, based on the output demand S2, and based on the selected control mode. The fuel pump flow demand S5 corresponds to a control signal for actuation or adjusting the operation of the fuel pump 4. The fuel pump flow demand S5 may, for example, represent a target rotational speed of the fuel pump 4. In step M9, the control device 1 may be configured to generate or output the pump flow demand S5 to the output interface 12 and, thereby, operate the fuel pump 4 according to the fuel pump flow demand S5 and based on the selected control mode to provide fuel to the injection rail 2.

As shown in FIG. 2, the method M may further include optional steps M6 and M7, which advantageously are performed before steps M8 and M9. In step M6, the control device may be configured to calculate an actual filling S6 of the injection rail 2 based on the actual pressure and on a type of the fuel. The filling of the injection rail 2 may correspond to the amount of fuel present or stored in the interior space of the injection rail 2. The filling, basically, represents the mass of fuel present in the rail 2, however, may be expressed by various quantities.

For example, the actual filling may be calculated as the filling ratio which is defined herein as $V_{cor}/V_0$, wherein $V_{cor}$ is a corrected volume of the fuel in the injection rail and $V_0$ is the geometric volume of the interior space of the injection rail 2. The corrected volume may be determined according to the following equation:

$$V_{cor} = V_0 + R_F \frac{V_0 * \Delta p}{E} + R_A \frac{Vo}{\kappa \ln \frac{p_r}{p_0}}$$

In this equation, $p_0$ is a reference pressure, e.g. the ambient pressure, $R_F$ is volumetric percentage of pure fuel at a reference pressure $p_0$, $R_A$ is volumetric percentage of pure fuel at a reference pressure $p_0$, $p_r$ is the actual pressure in the injection rail, $\Delta p$ is the difference between rail pressure $p_r$ and reference pressure $p_0$, $\kappa$ is the heat capacity ratio of air, which might be set as 1.34, for example, E is the coefficient of elasticity of the pure fuel.

In step M7, the control device M7 may be configured to calculate a total filling of the injection rail 2 based on the output demand S2. The total filling corresponds to the filling of the injection rail 2, when the amount of fuel corresponding to the output demand S2 would be added into the injection rail 2 which is already filled with the actual filling. In particular, the fuel pump 4 in step M9 may be operated such that the actual filling does not exceed an upper filling threshold and/or does not fall below a lower filling threshold, in particular, depending on the selected control mode.

Generally, the control mode may be selected among a plurality of pre-stored control modes. For example, the ECU 210 or the control unit 1 may be configured to store specific control schemes which are performed when a specific control mode is selected. Accordingly, as the fuel pump 4 is driven independently from the engine 200, the fuel pump 4 may flexibly be operated to provide fuel to the rail 2 adapted to various needs. In particular, each control mode may include at least one of a set value S1 of the target pressure and a target filling of the injection rail 2. For example, the set value S1 of the target pressure, depending on the control mode, may be a constant value or a dynamically varying value which is preferably set by the ECU 210.

Figure 3:
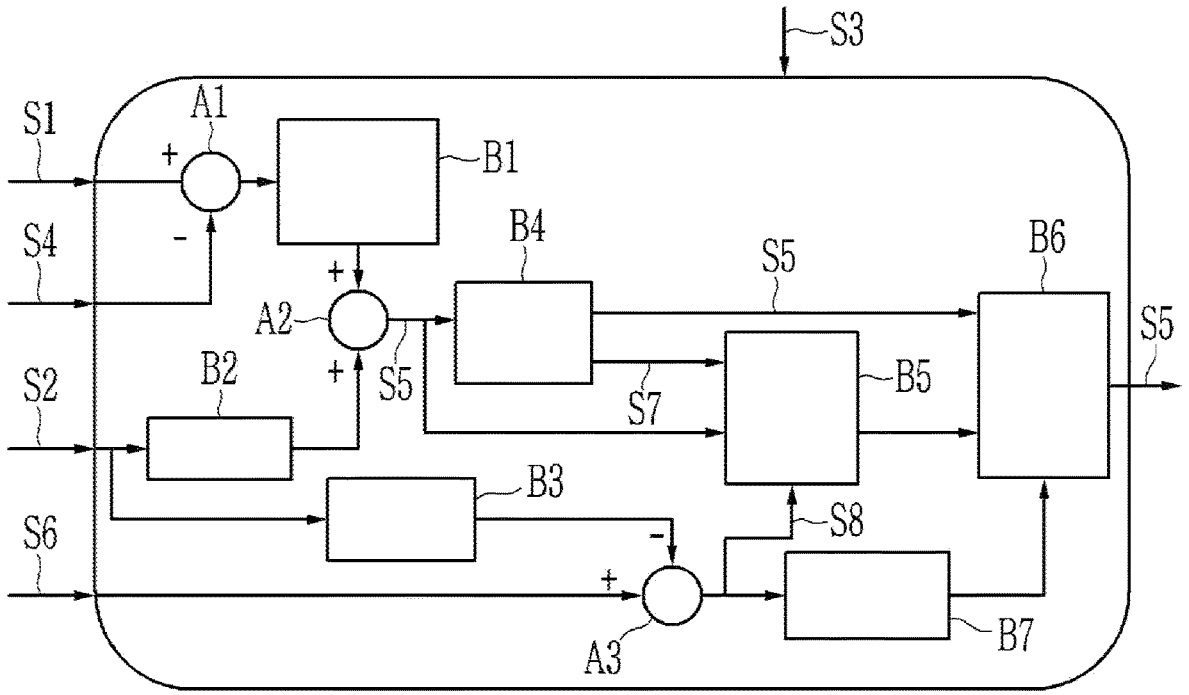
FIG. 3 shows a control routine of a first control mode carried out in a method for controlling a fuel injection system according to an exemplary embodiment of the invention.

FIG. 3 exemplarily shows a control routine carried out during steps M8 and M9 of the method M when a first control mode is selected in accordance with control modes signal S3. As is shown in FIG. 3, the control routine, as an input, receives the set value S1 for the target pressure, the actual pressure S4, the output demand S2, and the actual filling S6 of the injection rail 2. Thus, in the first control mode, the step M7 is performed, too.

As shown in FIG. 3, to determine the fuel pump flow demand S5, the actual pressure S4 and the target pressure S1 are provided to a subtraction block A1 which subtracts the actual pressure S4 from the target pressure S1 and outputs a corresponding error signal to a PI-control block B1. The PI-control block B1 issues an actuation signal to a summation block A2, wherein the PI-control block B1 issues the actuation signal based on the error signal according to a PI-rule. The actuation signal may, for example, be in the format of a value corresponding to a rotational speed of the fuel pump 4.

The output demand S2 may, for example, be provided in the format of a value corresponding to the volume of fuel to be injected. Thus, the output demand S2 preferably is provided to a converter block B2 which converts the format of the output demand to the format of the actuation signal of the PI-control block B1. In the present case, the output demand S2 therefore may be converted to a rotational speed of the fuel pump 4. Further, the converted output demand S2 is provided to the summation block A2 which adds the output demand S2 to the actuation signal and outputs the pump flow demand S5.

As schematically shown in FIG. 3, the fuel pump flow demand S5 is then provided to a pump efficiency evaluation block B4, on the one hand, routes the fuel pump flow demand S5 to a state switch block B6 which will be further described below. On the other hand, the efficiency evaluation block B4 calculate a pump efficiency as a ratio of hydraulic power to be applied to the fuel and driving power to be applied to the fuel pump 4 to reach the target pressure S1 in the injection rail 2. The pump efficiency $\eta$ may be approximated for an electrically driven pump, for example, according to the following equation:

$$\eta = \frac{\left[\frac{\dot{m}_F + \dot{m}_L + \dot{m}_R}{\rho_F} * (p_r - p_t)\right]}{U_B * I_P}$$

In this equation $U_B$ is the electrical voltage and $I_P$ the electrical current applied to the pump. Further, $p_r$ is the target rail pressure, $p_t$ is pressure in the fluid source, e.g. a tank, to which the fuel pump is connected, and $\rho_F$ is the density of the fuel. $\dot{m}_F$ is the mass flow of fuel represented by the output demand, $\dot{m}_L$ is a mass flow of leaked fuel, and $\dot{m}_R$ is the mass flow of fuel required to maintain or reach the target pressure in the injection rail. This calculation may, for example, be carried out in step M9.

The pump efficiency evaluation block B4 may be configured to output the calculated pump efficiency $\eta$ as an efficiency signal S7 to an eco-switch block B5 which will be described later by reference to FIG. 6. The eco-switch block B5 may further be configured to receive the fuel pump flow demand S5 from the summation block A2, as schematically shown in FIG. 3.

The output demand S2 may be provided to a second converter block B3 which may be configured to convert the format of the output demand S2 to the format in which the actual filling S6 is provided. For example, the actual filling S6 may be provided in the format of a filling ratio $V_{cor}/V_0$, wherein $V_{cor}$ is the corrected volume of the fuel in the injection rail 2 (see equation above) and $V_0$ is the geometric volume of the internal space of the injection rail 2. In particular, the output demand S2, when provided as volume may be divided by the geometric volume $V_0$ in block B3. The actual filling S6 and the converted output demand S2 may then be provided to a subtraction block A3 which subtracts the converted output demand S2 from the actual filling S6 and outputs the result S8 to the eco-switch block B5 and, optionally, to a comparator block B7. The comparator block B7 may be configured to compare the result S8 to a filling threshold value and outputs a logical value "0" or "1", depending on the comparison result, to the state switch B6. In particular, the comparator block B7 may be configured to output logical value "1" when the result S8 is smaller than a threshold and "0" when the result S8 is greater or equal than the threshold. The threshold may be one or 100%, when the actual filling S6 is provided as and the output demand S2 is converted to a filling ratio.

Figure 6:
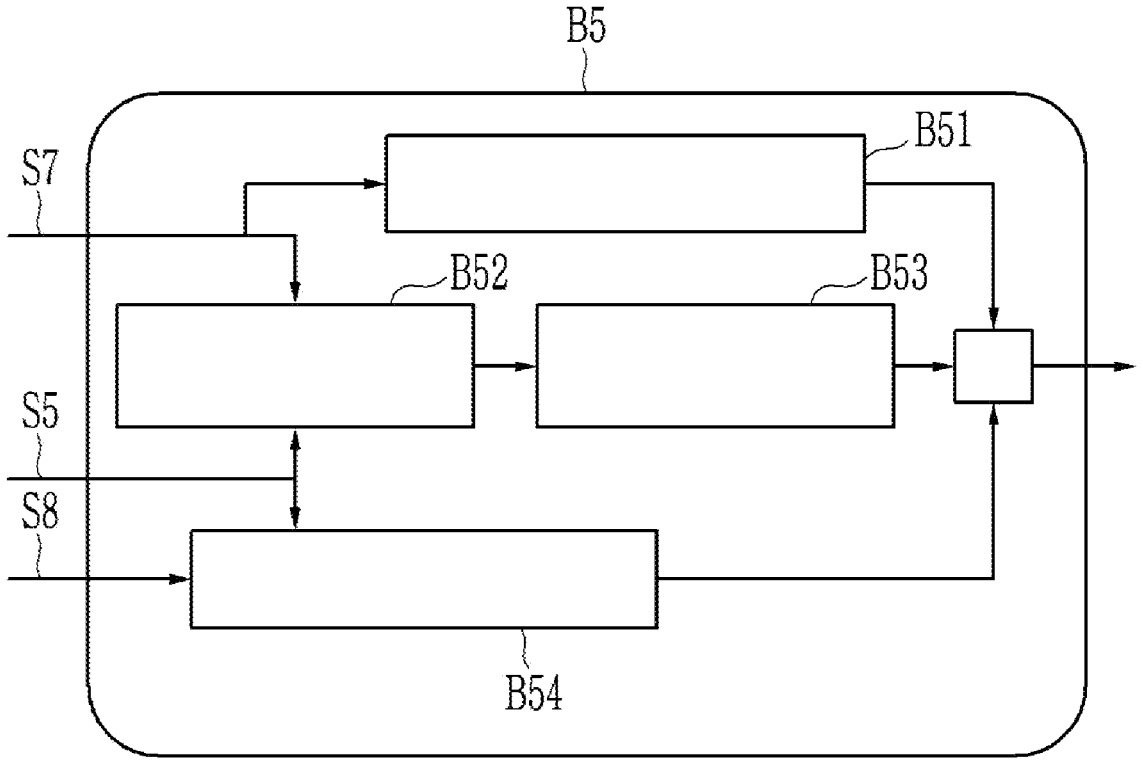
FIG. 6 shows a control routine performed in an eco-switch block of the control routines of FIGS. 3 and 5.

The eco-switch block B5 is shown in detail in FIG. 6. As exemplarily shown in FIG. 6, the eco-switch block B5 may be realized as a state machine that outputs logical values "1" and "0" depending on at least the determined pump efficiency signal S7 as an input signal. In other words, the eco-switch block B5 at least may include a comparator block B51 configured to compare the determined pump efficiency signal S7 to an efficiency threshold and output logical value "1", when the determined pump efficiency is greater or equal than the efficiency threshold, and "0", when the determined pump efficiency is less than the efficiency threshold. The efficiency threshold, for example, may be in the range between 0.25 and 0.5. For example, the efficiency threshold may be about 0.4.

As shown in FIG. 6, the eco-switch block B5 may further include an engine efficiency evaluation block B52 configured to receive the pump flow demand S5, e.g. in the format of a rotational speed such as rounds per minute or in the format of a flow such as kg/hour and the pump efficiency S7. The engine efficiency evaluation block B52 may be configured to determine a specific energy consumption of the fuel pump 4 based on the pump flow demand S5, the pump efficiency S7, and an engine specific fuel demand which is provided from a look-up-table. The specific energy consumption of the fuel pump 4 may then be provided to a further comparator block B53 which compares it to a specific energy consumption threshold and outputs logical value "1", when the specific energy consumption of the fuel pump 4 is less than the specific energy consumption threshold, and logical value "0", when the specific energy consumption of the fuel pump 4 is greater than the specific energy consumption threshold.

As further shown in FIG. 6, the eco-switch block B5 may include a further comparator block B54 configured to determine a resulting or total filling of the injection rail 2 from the pump flow demand S5 and the result S8 provided by the summation block A3 and compare it to a maximum admissible filling of the injection rail 2. The comparator block B54 may be configured to output logical value "1", when the total filling is less than the maximum admissible filling, and "0", when the total filling is greater or equal than the maximum admissible filling.

As further shown in FIG. 6, the logical outputs of comparator blocks B51, B53, B54 are provided to a multiplication block B56 which multiplies these values. Thus, the eco-switch block B5 may be configured to output logical value "1" when the logical values of each comparator blocks B51, B53, B54 is "1". As is shown in FIG. 3, the state switch block B6 may be configured to receive the fuel pump flow demand S5, the output of the eco-switch block B5, and the output of the comparator block B7 and output the of the fuel pump flow demand S5 to the output interface 12 of the control device 1 if one of the values received from the eco-switch block B5 and the comparator block B7 is "1".

Accordingly, in a first control mode, controlling M9 the operation of the fuel pump 4 may include calculating a pump efficiency as a ratio of hydraulic power to be applied to the fuel and driving power to be applied to the fuel pump 4 to reach the target pressure S1 in the injection rail 2. The fuel pump 4 is only operated when the calculated pump efficiency is greater than an efficiency threshold (comparison block B51) and, optionally, when the other comparison blocks B53, B54 in the eco-switch block B5 output "1". Optionally, when the calculated pump efficiency is less than the efficiency threshold, the fuel pump 4 is only operated when the actual filling of the injection rail 2 is less than or equal to a filling threshold value depending on the fuel demand, which results from the comparison in block B7.

Figure 4:
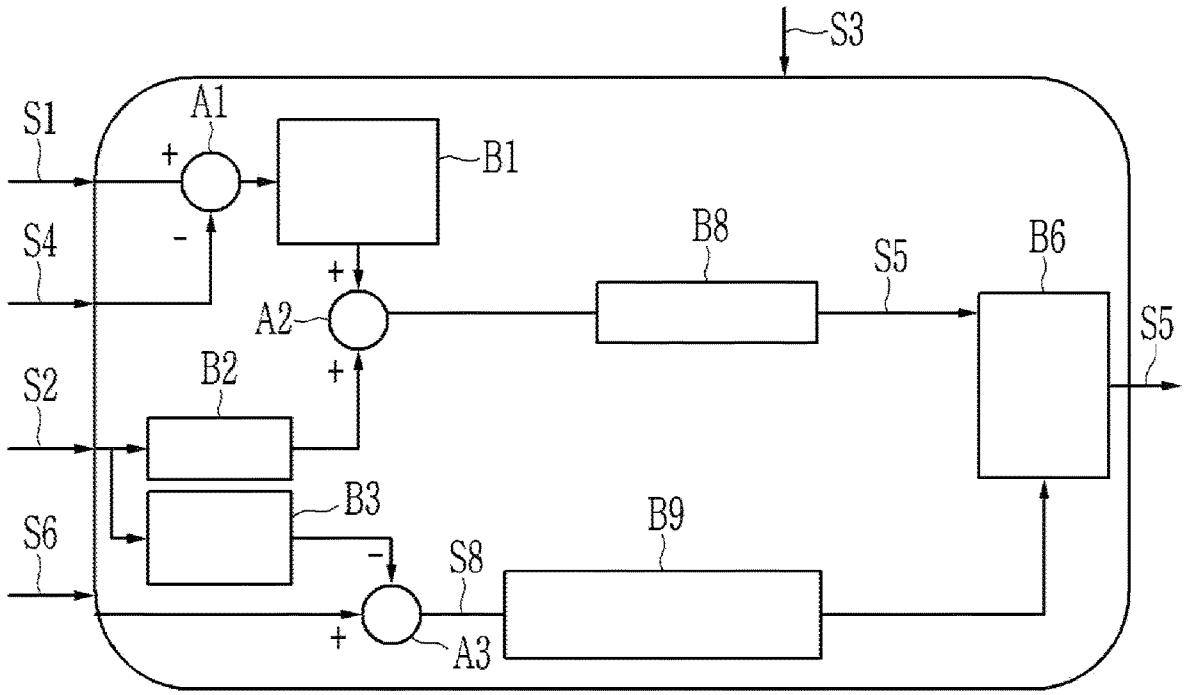
FIG. 4 shows a control routine of a first control mode carried out in a method for controlling a fuel injection system according to an exemplary embodiment of the invention.

FIG. 4 exemplarily shows a control routine performed during steps M8 and M9 of the method M when a second control mode is selected in accordance with control mode signal S3. As is shown in FIG. 4, the control routine, as an input, receives the set value S1 for the target pressure, the actual pressure S4, the output demand S2, and the actual filling S6 of the injection rail 2. Thus, in the second control mode, the step M7 is performed, too.

In the second control mode, the fuel pump flow demand S5 may be determined in the same way as explained for the first control mode. In particular, the actual pressure S4 and the target pressure S1 may be provided to the subtraction block A1 which subtracts the actual pressure S4 from the target pressure S1 and outputs a corresponding error signal to the PI-control block B1. The PI-control block B1 issues an actuation signal to a summation block A2, wherein the PI-control block B1 issues the actuation signal based on the error signal according to a PI-rule. The actuation signal may, for example, be in the format of a value corresponding to a rotational speed of the fuel pump 4 or in the format of a pressure.

The output demand S2 may, for example, be provided in the format of a value corresponding to the volume of fuel to be injected. Thus, as shown in FIG. 4, the output demand S2 preferably is provided to the converter block B2 configured to convert the format of the output demand to the format of the actuation signal of the PI-control block B1. In the second control mode, the output demand S2, for example, may be converted to a pressure value. Further, the converted output demand S2 may be provided to the summation block A2 configured to add the output demand S2 to the actuation signal and outputs the pump flow demand S5. Hence, in the second control mode, determining M7 the fuel pump flow demand S5 may include determining a first fuel pump flow demand percentage based on the difference between the set value S1 for the target pressure and the actual pressure. The first fuel pump flow demand percentage corresponds to the output of the PI-block B1. Likewise, in the second control mode, determining M7 the fuel pump flow demand S5 may further include adding the determined first fuel pump flow demand percentage to a second fuel pump flow demand percentage proportional to the output demand S2. As visible from FIG. 4, the second fuel pump flow demand percentage may correspond to the output of the converter block B2.

As shown in FIG. 4, the fuel pump flow demand S5 may be provided to a limiter block B8 which maintains the fuel pump flow demand S5, in particular a variation over time of the fuel demand, within predefined thresholds to prevent damages of the pump 4. Further, also in the second control mode, the output demand S2 may be provided to a second converter block B3 which may convert the format of the output demand S2 to the format in which the actual filling S6 is provided. For example, the actual filling S6 may be provided in the format of the filling ratio $V_{cor}/V_0$, as explained above. Thus, the output demand S2, when provided as volume may be divided by the geometric volume $V_0$ in block B3. The actual filling S6 and the converted output demand S2 are then provided to the subtraction block A3 configured to subtract the converted output demand S2 from the actual filling S6 and output the result S8 to a comparator block B9. Comparator block B9 may be configured to determine, from the result S8, whether the output demand S2 is greater or equal than the maximum admissible filling of the injection rail 2. In response to the Comparator block B9 determining that the output demand S2 is greater or equal than the maximum admissible filling of the injection rail 2, the Comparator block B9 may be configured output logical value "1". In response to Comparator block B9 determining that the output demand S2 is less than the maximum admissible filling of the injection rail 2, the Comparator block B9 may be configured to output logical value "0".

The output of the comparator block B9 and the output of the limiter block B8 (fuel pump flow demand S5) may be provided to the state switch block B6. In the second control mode, the state switch block B6 causes issuance of the of the fuel pump flow demand S5 to the output interface 12 of the control device 1 if the value received from the comparator block B8 is "0". If the value received from the comparator block B8 is "1", the state switch block B6 does not output the fuel pump flow demand S5 and, thus, inhibits or stops operation of the pump. Hence, in the second control mode, controlling M9 the operation of the fuel pump 4 may include operating the fuel pump 4 such that operation of the fuel pump 4 is inhibited, in particular stopped, when the output demand S2 compared to the actual filling exceeds a predetermined threshold.

Figure 5:
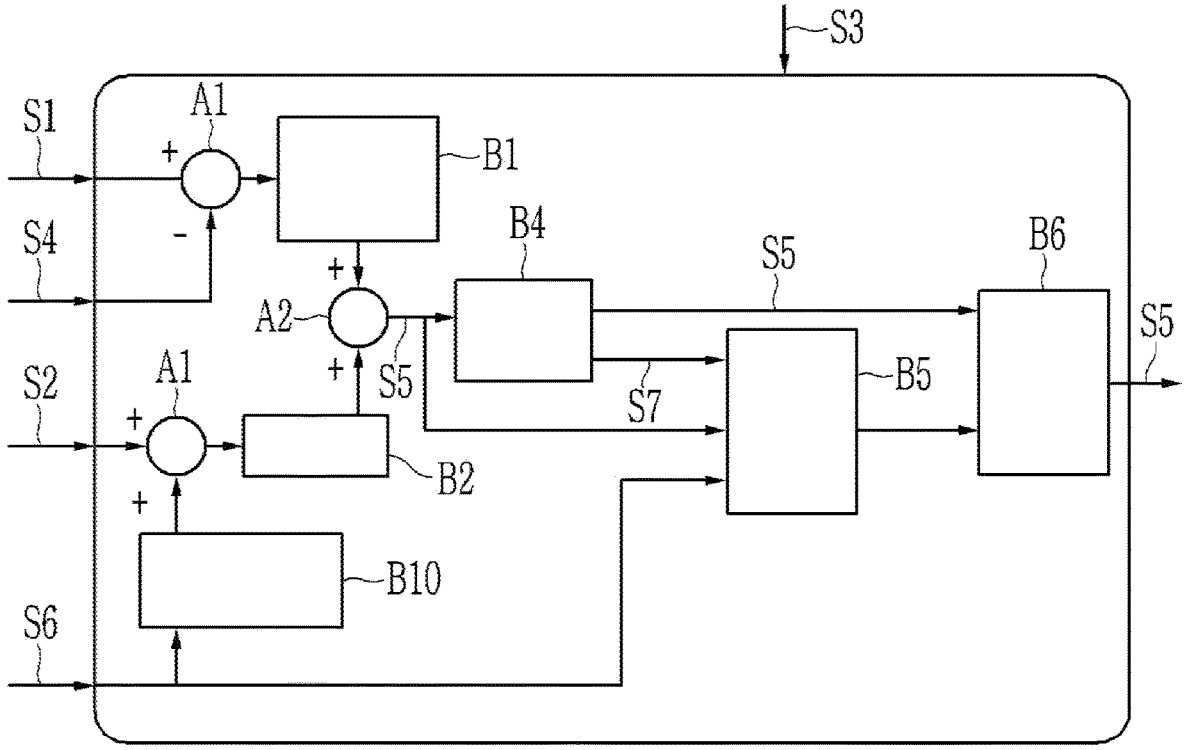
FIG. 5 shows a control routine of a first control mode carried out in a method for controlling a fuel injection system according to an exemplary embodiment of the invention.

FIG. 5 exemplarily shows a control routine carried out during steps M8 and M9 of the method M when a third control mode is selected in accordance with control modes signal S3. As is shown in FIG. 5, the control routine, as an input, receives the set value S1 for the target pressure, the actual pressure S4, the output demand S2, and the actual filling S6 of the injection rail 2. Thus, in the first control mode, the step M7 is performed, too.

As shown in FIG. 5, to determine the fuel pump flow demand S5, similar as in FIG. 3, the actual pressure S4 and the target pressure S1 may be provided to a subtraction block A1 which subtracts the actual pressure S4 from the target pressure S1 and outputs a corresponding error signal to a PI-control block B1. The PI-control block B1 issues an actuation signal to a summation block A2, wherein the PI-control block B1 issues the actuation signal based on the error signal according to a PI-rule. The actuation signal may, for example, be in the format of a value corresponding to a rotational speed of the fuel pump 4.

As is shown in FIG. 5, the actual filling S6 may be provided to a calculation block B10, for example, in the format of a filling ratio. The calculation block B10 may be configured to calculate an effective available filling of the injection rail by subtracting the maximum filling of the injection rail 2 at the target pressure S1 from the actual filling of the injection rail. The actual filling may be determined as product of the geometric volume $V_0$ of the injection rail 2 and the filling ration provided with signal S6. The maximum filling of the injection rail 2 at the target pressure S1 may be determined as corrected volume $V_{cor}$ with the above mentioned formula in which for $p_r$ the set value S2 of the target pressure is set.

As shown in FIG. 5, the calculated effective available filling output by the calculation block B10 and the output demand S2 may be provided to a summation block A4. The summation block A4 may be configured to add the output demand S2 and the effective available filling volume and, therefore, determine an effective demand. The effective demand may, for example, be provided to a converter block B2 configured to convert the format of the effective demand to the format of the output of the PI-control block B1. In the present case, the output demand S2 therefore may be converted to a rotational speed of the fuel pump 4. The effective demand is then provided to the summation block A2 configured to output the fuel pump flow demand S5 as the sum of the effective demand and the output of the PI-block B1.

Consequently, in the third control mode, calculating the fuel pump flow demand S5 may include calculating an effective available filling of the injection rail 2 as a difference between a maximum filling of the injection rail 2 at the target pressure S1 and the actual filling, and determining an effective demand by adding the output demand S2 and the effective available filling volume.

As exemplarily shown in FIG. 5, in the third control mode, optionally, the fuel pump flow demand S5 may be input to a pump efficiency evaluation block B4 which determines a pump efficiency as described above by reference to FIG. 3. As further apparent from FIG. 5, the determined pump efficiency S7, the fuel pump flow demand S5, and the actual filling S6 may be provided to an eco-switch block B5, which works as explained above by reference to FIG. 6. It should be noted, that in this case, the eco-switch block B5 may be configured to directly receive the actual filling S6 and, therefore, block B54 already receives the actual filling and not necessarily is required to determine it from the fuel pump flow demand S5 as stated above. As also shown in FIG. 5, the output of the eco-switch block B5 and the fuel pump flow demand S5 routed through by the optional pump efficiency evaluation block B4 may be provided to state switch block B6 which outputs the fuel pump flow demand S5 to the output interface 12 of the control unit 1, when the output of the eco-switch is "1".

Although the here afore-mentioned method and system have been described in connection to vehicles, for a person skilled in the art it is clearly and unambiguously understood that the here described system and method can be applied to various objects which comprise internal combustion engines.

The invention has been described in detail referring to exemplary embodiments. However, it will be appreciated by those of ordinary skill in the art that modifications to these embodiments may be made without deviating from the principles and central ideas of the invention, the scope of the invention defined in the claims, and equivalents thereto.

REFERENCE LIST 1 control device
2 injection rail
3 pressure sensor
4 fuel pump
5 mode selection switch
10 processing unit
11 input interface
12 output interface
100 fuel injection system
200 internal combustion engine
205 tank
210 engine control unit/ECU
215 gas pedal
A1 subtraction block
A2 summation block
A3 subtraction block
A4 summation block
B1 PI-control block
B2 converter block
B3 converter block
B4 pump efficiency evaluation block
B5 eco-switch block
B6 state switch block
B7 comparator block
B8 limiter block
B9 comparator block B10 calculation block
B51 comparator block of the eco-switch block
B52 engine efficiency evaluation block
B53 comparator block of the eco-switch block
B54 comparator block of the eco-switch block
M method
M1-M9 method steps
S1 set value for target pressure
S2 output demand
S3 control mode signal
S4 actual pressure
S5 fuel pump flow demand
S7 pump efficiency
S8 result

What is claimed is:

1. A method for controlling a fuel injection system of an internal combustion engine, comprising:

receiving, by a controller, a set value for a target pressure in an injection rail that provides fuel to the engine;

receiving, by the controller, an output demand representing a target amount of fuel to be injected from the injection rail per engine cycle;

receiving, by the controller, a control mode signal;

capturing, by the controller, an actual pressure in the injection rail;

selecting, by the controller, a control mode based on the control mode signal;

determining, by the controller, a fuel pump flow demand for a fuel pump connected to the injection rail based on a difference between the set value for the target pressure and the actual pressure, based on the output demand, and based on the selected control mode; and operating, by the controller, the fuel pump according to the fuel pump flow demand and based on the selected control mode to provide fuel to the injection rail, wherein the fuel pump is operated independently from a rotational speed of the engine.

2. The method according to claim 1, wherein the control mode is selected among a plurality of pre-stored control modes, and wherein each control mode includes at least one of a set value of the target pressure and a target filling of the injection rail.

3. The method according to claim 1, further including:

calculating an actual filling of the injection rail based on the actual pressure and on a type of the fuel, and calculating a total filling of the injection rail based on the output demand, wherein the fuel pump is operated such that the actual filling does not exceed an upper filling threshold and does not fall below a lower filling threshold.

4. The method according to claim 3, wherein, in a first control mode, the operating of fuel pump includes:

calculating a pump efficiency as a ratio of hydraulic power to be applied to the fuel and driving power to be applied to the fuel pump to reach the target pressure in the injection rail, wherein the fuel pump is only operated when the calculated pump efficiency is above an efficiency threshold.

5. The method according to claim 4, wherein, when the calculated pump efficiency is below the efficiency threshold, is only operated when the actual filling of the injection rail is less than or equal to a filling threshold value depending on the fuel demand.

6. The method according to claim 3, wherein, in a second control mode, determining the fuel pump flow demand includes:

determining a first fuel pump flow demand percentage based on the difference between the set value for the target pressure and the actual pressure and adding the determined first fuel pump flow demand percentage to a second fuel pump flow demand percentage proportional to the output demand, wherein an actual filling of the injection rail is calculated based on the actual pressure and on a type of the fuel, and wherein operating the fuel pump includes operating the fuel pump such that operation of the fuel pump is inhibited, in particular stopped, when the output demand compared to the actual filling exceeds a predetermined threshold.

7. The method according to claim 3, wherein, in a third control mode, calculating the fuel pump flow demand includes:

calculating an actual filling of the injection rail based on the actual pressure and on a type of the fuel;

calculating an effective available filling of the injection rail as a difference between the actual filling and a maximum filling of the injection rail at the target pressure; and determining an effective demand by adding the output demand and the effective available filling.

* * * * *